US005802777A

United States Patent [19]

Sato et al.

[11] Patent Number: 5,802,777

[45] Date of Patent: Sep. 8, 1998

[54] PROTECTION COVER FOR EAVES GUTTER

[75] Inventors: Hiroki Sato; Katsuko Sato; Masayuki Sato; Yasuko Sakurayama, all of Saku, Japan

[73] Assignee: Hiroki & Co., Ltd., Saku, Japan

[21] Appl. No.: 889,684

[22] Filed: Jul. 8, 1997

[30] Foreign Application Priority Data

Jul. 29, 1996 [JP] Japan ..... 8-216602

[51] Int. Cl.[6] ..... E04D 13/076

[52] U.S. Cl. ..... 52/12; 52/11

[58] Field of Search ..... 52/11, 12

[56] References Cited

U.S. PATENT DOCUMENTS

| | | | |
|---|---|---|---|
| 550,173 | 11/1895 | Hitt | 52/12 |
| 870,165 | 11/1907 | Hagler et al. | 52/12 X |
| 3,023,544 | 3/1962 | Hughes | 52/12 |
| 3,428,183 | 2/1969 | Bristow | 52/12 X |
| 4,553,356 | 11/1985 | Pepper | 52/12 X |
| 4,856,237 | 8/1989 | Wigle | 52/12 |
| 5,044,581 | 9/1991 | Dressler | 52/12 X |

FOREIGN PATENT DOCUMENTS 71133 7/1995 Japan .

*Primary Examiner*—Christopher Kent
*Attorney, Agent, or Firm*—Price, Gess & Ubell

[57] ABSTRACT

A protection cover for an eaves gutter capable of permitting snow lumps, fallen leaves, pebbles, sand, dust and the like dropping from an eaves edge of a roof to smoothly slip off the protection cover to drop onto the ground under the eaves and thus preventing them from entering the eaves gutter. The protection cover includes a net cover body fitted on an upper opening of the eaves gutter. The net cover body is formed so as to have a central portion upwardly arcuately expanded and both lateral portions laterally arcuately expanded while being downwardly inclined from the central portion. The protection cover also includes a pair of fixing frames for tightly fixing opposite lateral edges of the net cover body to respective lateral upper edges of the eaves gutter.

12 Claims, 2 Drawing Sheets

PROTECTION COVER FOR EAVES GUTTER

BACKGROUND OF THE INVENTION

1. Field of the Invention

This invention relates to a protection cover for an eaves gutter, and more particularly to an eaves gutter protection cover which is adapted to protect an eaves gutter from snow lumps, waste or the like to prevent damage to the eaves gutter and the like.

2. Description of Related Art

An eaves gutter is generally formed with an arcuate or semicircular shape in cross section, to thereby have an opening formed at one end thereof. The eaves gutter is arranged along an eaves edge of a roof while keeping the opening upwardly facing, so that rainwater dropping from the eaves edge may be received therein through the upper opening. The rainwater thus received or collected is then guided through the eaves gutter to a drainage pipe connected to the eaves gutter and arranged on a side of a building so as to vertically extend along the side.

In a heavy snowfall area or region, the eaves gutter causes snow lumps slipping off a surface of a roof to fail to often get over the eaves gutter, to thereby enter the eaves gutter or be caught in the eaves gutter. Unfortunately, this leads to deformation of the eaves gutter made of a metal plate or the like, falling of the eaves gutter from a support therefor, damage to the eaves gutter or the like, so that the eaves gutter fails to carry out satisfactory drainage of rainwater while positively receiving it therein.

Also, fallen leaves, sand, mud, dust and the like in addition to rainwater frequently enter the eaves gutter, to thereby cause the eaves gutter to be clogged therewith. Thus, it is required to periodically clean the eaves gutter to remove the obstruction.

In order to solve the above-described problems, a protection cover for an eaves gutter is proposed as disclosed in Japanese Utility Model Application Laid-Open Publication No. 1133/1995. The proposed protection cover is constructed so as to cover an upper opening of the eaves gutter with a net cover member arranged on the eaves gutter so as to horizontally extend thereon. The net cover member functions to prevent snow lumps, fallen leaves, pebbles, sand, dust and the like dropping from an eaves edge of a roof from entering the eaves gutter.

Unfortunately, the proposed protection cover causes snow lumps dropping from the eaves edge of the roof to be caught by the horizontally extending net cover member, to thereby lead to deformation of the eaves gutter or removal of the eaves gutter from a support therefor due to a weight of the snow lamps.

Likewise, fallen leaves, pebbles, sand, dust or the like is caught by the net cover member horizontally stretchedly arranged, so that the net cover member is clogged therewith, to thereby fail to smoothly pass rainwater therethrough to guide it into the eaved gutter. Thus, it is required to periodically clean the net cover member to remove them therefrom with much labor.

SUMMARY OF THE INVENTION

The present invention has been made in view of the foregoing disadvantages of the prior art.

Accordingly, it is an object of the present invention to provide a protection cover for an eaves gutter which is capable of permitting snow lumps dropping from an eaves edge of a roof to smoothly slip off the protection cover and to drop onto the ground under eaves.

It is another object of the present invention to provide a protection cover for an eaves gutter which is capable of effectively preventing fallen leaves, pebbles, sand, dust and the like from entering the eaves gutter and permitting them to effectively slip off the protection cover without being caught by the eaves gutter while ensuring positive introduction of rainwater dropping from a roof thereinto.

It is a further object of the present invention to provide a protection cover for an eaves gutter which is capable of reducing a manufacturing cost thereof.

In accordance with a present invention, a protection cover for an eaves gutter is provided. The protection cover includes a net cover body fitted on an upper opening of the eaves gutter. The net cover body is formed so as to have a central portion upwardly expanded and both lateral portions downwardly inclined from the central portion. The protection cover also includes a fixing means for fixing opposite lateral edges of the net cover body to respective lateral upper edges of the eaves gutter.

In the protection cover of the present invention thus constructed, the net cover body is arranged on the eaves gutter so as to cover the upper opening. Then, the net cover body is fixed to the lateral upper edges of the eaves gutter by means of the fixing means. Thus, the protection cover permits rainwater dropping from an eaves edge of a roof to be smoothly introduced through the net cover member into the eaves gutter. Thereafter, the rainwater is guided through the eaves gutter to a drainage pipe connected to thereto.

Also, the protection cover permits snow lumps dropping from a roof to be fended off by the net cover body arranged for covering the upper opening of the eaves gutter while preventing them from entering the eaves gutter.

Further, the net cover body, as described above, is so constructed that the central portion is upwardly expanded and the lateral portions are downwardly inclined from the central portion. Such construction permits snow lumps dropping onto the net cover body to smoothly slip off the net cover body to drop onto the ground under the eaves.

Moreover, the protection cover permits fallen leaves, pebbles, sand, dust or the like to be likewise fended off by the net cover body while preventing them from entering the eaves gutter.

In a preferred embodiment of the present invention, the net cover body is so formed that the central portion thereof is upwardly arcuately expanded and both the lateral portions thereof are laterally arcuately expanded. Such construction further enhances the above-described function and advantage of the present invention.

Also, in a preferred embodiment of the present invention, the net cover body is formed with square meshes, the sides of each of the meshes being respectively about 4 mm. Such construction effectively prevents rainwater from adhering to the meshes of the net cover in a film-like manner due to surface tension. Also, it permits rainwater to be positively introduced into the eaves gutter in the case of heavy rain as well as light rain. Further, it prevents snow lumps, fallen leaves, dust and the like from entering the eaves gutter.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a protection cover for an eaves gutter according to the present invention will be described hereinafter with reference to the accompanying drawings.

Figure 1:
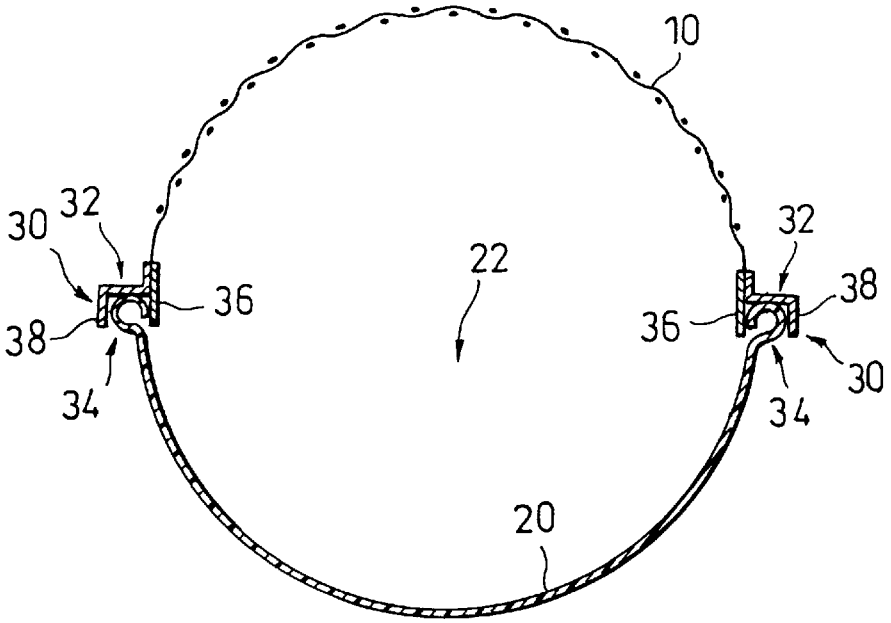
FIG. 1 is a sectional view showing an embodiment of a protection cover for an eaves gutter according to the present invention, in which the protection cover is kept mounted on the eaves gutter for protection thereof.
Figure 2:
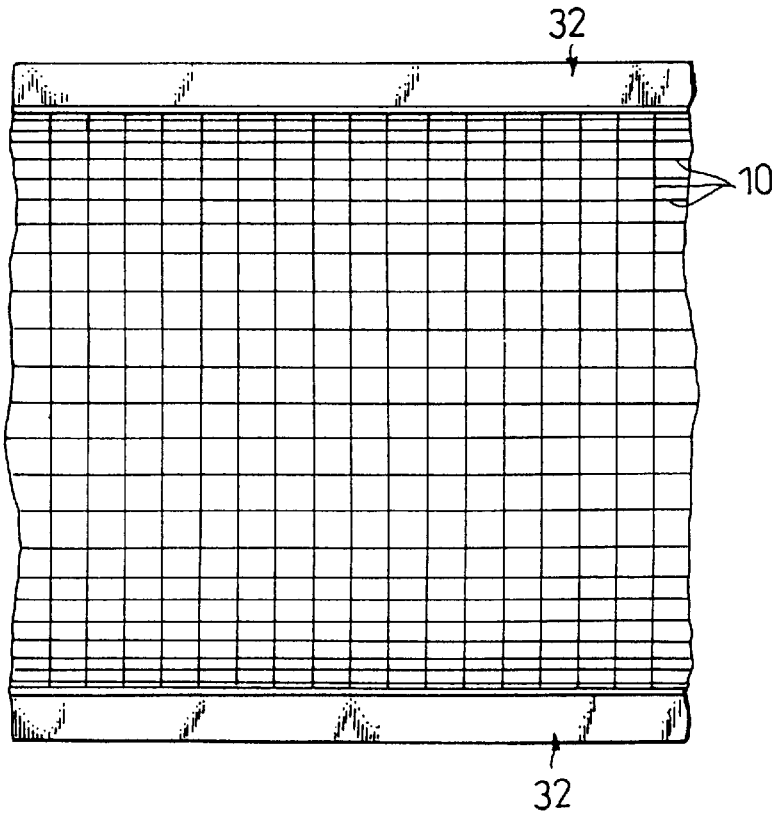
FIG. 2 is a fragmentary plan view showing a part of the protection cover of FIG. 1.

Referring first to FIGS. 1 and 2, an embodiment of a protection cover for an eaves gutter according to the present invention is illustrated. A protection cover of the illustrated embodiment includes a net cover body 10 which is adapted to cover an opening 22 of an eaves gutter 20 formed with an arcuate or semicircular shape in cross section and arranged so that the opening 22 upwardly faces. Thus, the net cover body 10, as shown in FIG. 1, is formed with an arcuate or semicircular shape wherein one end thereof is open or formed with an opening and the other end thereof is closed while being outwardly expanded or projected. Thus, the net cover body 10 is formed so as to have a central portion upwardly expanded and both lateral portions downwardly inclined from the central portion. The net cover body 10 thus constructed is arranged on or placed on the eaves gutter 20 in such a manner that the open end thereof is aligned with the upper opening 22 of the eaves gutter 20, resulting in generally forming a ring-like shape in cross section by cooperation with the eaves gutter 20, as shown in FIG. 1. In the illustrated embodiment, the net cover body 10 is made of a stainless steel wire. Alternatively, it may be made of any other suitable material such as a water-resistant plastic wire or the like.

The net cover body 10 may be formed with square meshes so that the sides of each of the meshes are respectively about 4 mm in length. Such construction permits rainwater dropping from an eaves edge of a roof to be appropriately guided into an interior of the eaves gutter 20 through the square meshes of about 4 mm in size of the net cover body 10 without outwardly leaking or spilling in the case of heavy rain as well as light rain. Also, it effectively prevents snow lumps, fallen leaves, pebbles, sand, dust or the like from entering the eaves gutter 20 through the net cover body 10.

The protection cover of the illustrated embodiment, as shown in FIG. 1, also includes fixing frames 32 of a substantially U-shape in cross section mounted on each of opposite lateral edges or ends of the net cover body 10 so as to extend along the side edge of the net cover body 10 in a longitudinal direction thereof while keeping an opening 34 thereof downwardly facing. The fixing frames 32 thus constructed constitute a fixing means 30 for fixing or locking the opposite lateral edges of the net cover body 10 on the respective lateral upper edges or ends of the eaves gutter 20.

The fixing frames 32 are each constructed of a flat plate 36 and a strip-like frame plate 38 each made of stainless steel and joined to each other. The flat plate 36 has an upper end arranged so as to cooperate with an upper end of the strip-like frame plate 38 to interposedly support a corresponding one of the lateral edges of the net cover body 10 therebetween, resulting in reinforcing the lateral edges of the net cover body 10 and preventing lateral and/or vertical deflection of the net cover body 10.

In the protection cover of the illustrated embodiment thus constructed, as shown in FIG. 1, the net cover body 10 is put or arranged on the upper open end of the eaves gutter 20 to cover the upper opening 22 of the eaves gutter 20. Then, the lateral upper ends of the eaves gutter 20 which are bent into a substantially cylindrical shape are each securely fitted through the opening 34 of each of the fixing frames 32 of the protection cover in the fixing frame 32. Thereafter, the net cover body 10 is fixed at both lateral ends thereof to the both lateral upper ends of the eaves gutter 20.

Thus, rainwater dropping from an eaves edge of a roof is permitted to flow through the meshes of the net cover body 10 arranged on the eaves gutter 20 into the eaves gutter. The rainwater is then guided through the eaves gutter 20 to a drainage line connected to the eaves gutter 20 while flowing in the eaves gutter 20, resulting in being carried off.

The net cover body 10 of the protection cover fitted on the eaves gutter 20 so as to cover the upper opening 22 of the eaves gutter 20 also functions to effectively fend off snow lumps dropping from the eaves edge of the roof thereonto, to thereby prevent the snow lumps from entering the eaves gutter 20.

Also, the net cover body 10 permits the snow lumps thus fended off by the net cover body 10 to positively slip off an outer surface of the net cover body 10 along both lateral portions of the net cover body 10, because the central portion of the outer surface of the net cover body 10 is upwardly arcuately protruded or expanded and both lateral portions thereof are downwardly inclined while being outwardly arcuately expanded, so that the snow lumps may be effectively dropped onto the ground under the eaves.

Further, the net cover body 10 effectively prevents fallen leaves, pebbles, dust or the like from entering the eaves gutter 20 because it tightly covers the upper opening 22 of the eaves gutter 20.

More particularly, the net cover body 10 permits fallen leaves, pebbles, dust or the like to slip off the outer surface of the net cover body of which the central portion is upwardly arcuately expanded and both lateral portions are laterally arcuately expanded while being downwardly inclined, resulting in being effectively dropped onto the ground under the eaves.

Alternatively, the net cover body 10 may be so configured that the central portion thereof is expanded in a mountain-like manner and both lateral portions thereof are downwardly flatly inclined. Such configuration of the net cover body 10 likewise permits snow lumps, waste or the like dropped onto the net cover body 10 to smoothly slip off the outer surface of the net cover body 10, resulting in being likewise dropped onto the ground under the eaves.

The above-described configuration of the net cover body 10 wherein the central portion thereof is arcuately expanded and both lateral portions thereof are laterally arcuately expanded while being downwardly inclined permits the outer surface of the net cover body 10 to be laterally outwardly curved in an arcuate manner, so that snow lumps, waste or the like dropped onto the protection cover can be received by the outer surface of the net cover body 10 in a line-contact state rather than a surface-contact state, resulting in frictional resistance between the snow lumps or the like and the net cover body 10 being significantly reduced. Accordingly, the snow lumps, waste or the like dropped onto the protection cover is permitted to smoothly and positively slip off the outer surface of the net cover body 10.

Alternatively, the protection cover of the illustrated embodiment may be so constructed that the net cover body 10 is formed with square meshes each of which has the respective sides smaller than about 4 mm in length. Such configuration causes resistance of rainwater passing through the net cover body 10 to be somewhat increased. Instead, it permits the net cover body 10 to more effectively prevent snow lumps, waste or the like from entering the eaves gutter 20. Alternatively, each of the square meshes of the net cover body 10 may be so formed that the sides thereof are respectively larger than about 4 mm. This permits resistance of rainwater passing through the meshes of the net cover body 10 to be reduced, so that rainwater may positively enter the eaves gutter 20 through the meshes of the net cover body thus increased in size. Also, the meshes of the net cover body 10 may be formed with any suitable shape such as a hexagonal shape, a circular shape or the like other than the above-described square shape.

Figure 3:
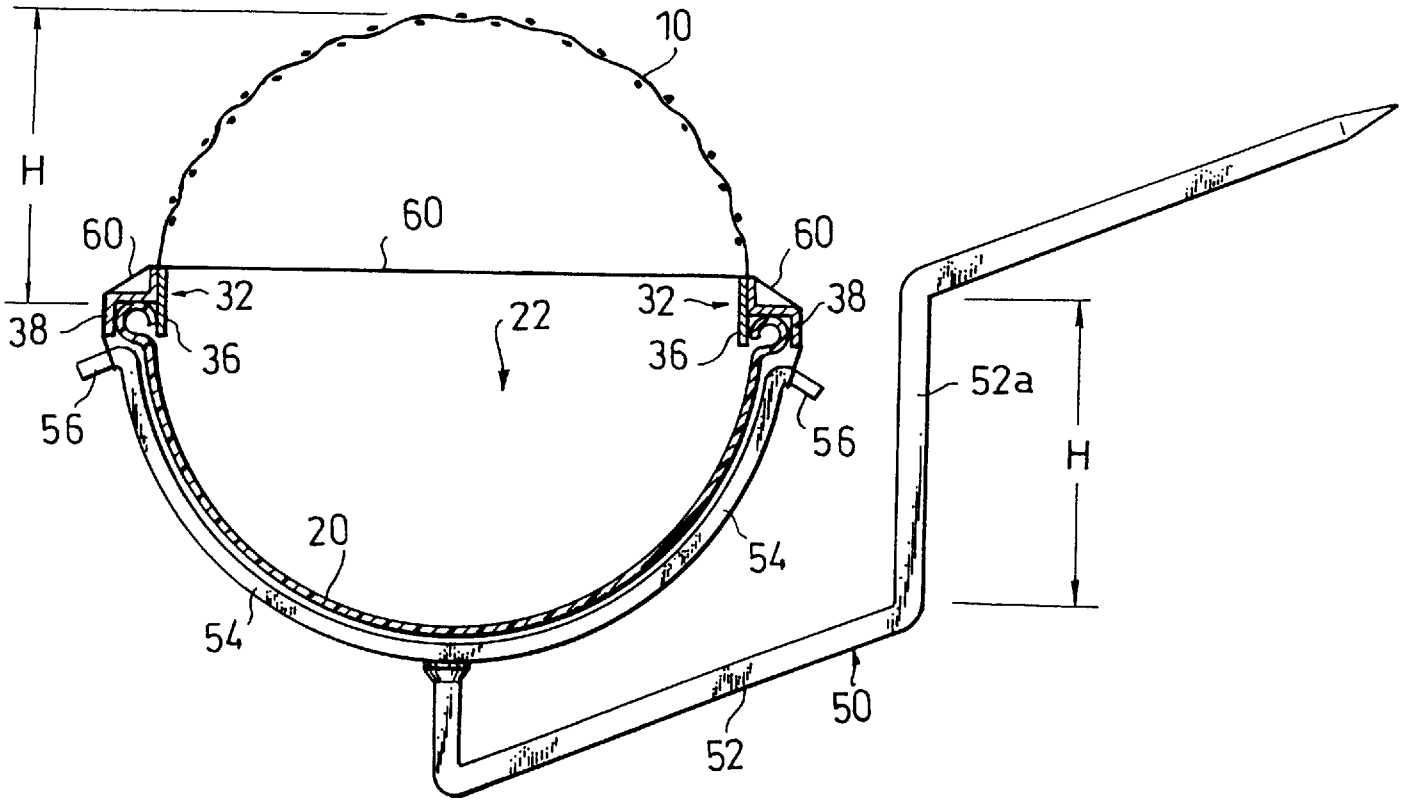
FIG. 3 is a sectional view showing mounting of the protection cover of FIG. 1 on a support for an eaves gutter.

Mounting of the protection cover of the illustrated embodiment on the eaves gutter 20 may be carried out in such a manner as shown in FIG. 3. More particularly, the eaves gutter 20 may be supported on a support 50. The support 50 includes a support rod 52, which is provided at an intermediate portion thereof with a vertically extending section 52*a* of a height H. The eaves gutter 20 having the net cover body 10 mounted thereon is supported on the support 50 while being downwardly deviated by a distance H corresponding to the central height H of the net cover body, resulting in preventing the net cover body 10 from abutting against or obstructing the eaves edge.

Also, when the eaves gutter 20 having the protection cover mounted thereon is arranged at the eaves edge by means of the support 50, a wire 60 is stretchedly arranged so as to extend between portions of the net cover body 10 right above the fixing frames 32 and be outwardly led out of the portions. Then, the wire 60 is held at opposite ends thereof on hooks 56 provided on opposite lateral ends of an arcuate support arm 54 of the support 50 for receiving the eaves gutter 20 therein. This results in the eaves gutter 20, as well as the protection cover being safely and firmly fixed on the support 50.

As can be seen from the foregoing, the protection cover of the present invention is so constructed that the net cover body is arranged on the upper opening of the eaves gutter, to thereby permit snow lumps or the like dropping on the protection cover to slip off the outer surface of the net cover body while preventing them from entering the eaves gutter, resulting in the snow lumps being effectively dropped onto the ground under the eaves. This effectively prevents damage to the eaves gutter or a deterioration in function of the eaves gutter due to the snow lumps or the like.

Likewise, fallen leaves, pebbles, sand, dust and the like dropping on the protection cover are permitted to slip off the outer surface of the net cover body, to thereby be prevented from entering the eaves gutter, resulting in dropped onto the ground. This not only prevents damage to the eaves gutter or a deterioration in function of the eaves gutter due to the snow lumps or the like, but eliminates periodic troublesome cleaning of the eaves gutter.

Further, the protection cover of the present invention ensures that rainwater dropping on the protection cover is guided through the meshes of the net cover body into the eaves gutter without leaking or spilling from the eaves gutter and then guided to a drainage pipe connected to the eaves gutter.

Moreover, the protection cover of the present invention includes the fixing means for fixing the opposite lateral edges of the net cover body to the respective lateral upper edges of the eaves gutter. The fixing means permits the net cover body to be tightly and smoothly secured to the eaves gutter while preventing any gap or recess from being formed between the lateral edges of the net cover body and the upper edges of the eaves gutter, resulting in keeping snow lumps, fallen leaves, pebbles, sand, dust or the like from entering the eaves gutter through a lateral connection between the net cover body and the eaves gutter or being caught by the lateral connection. Thus, it will be noted that the fixing means ensures that the snow lumps and the like may smoothly slip off the outer surface of the net cover body, to thereby drop onto the ground under the eaves.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A protection cover for an eaves gutter, comprising:

a net cover body adapted to be fitted on an upper opening of the eaves gutter;

said net cover body being formed so as to have a central portion upwardly expanded and a pair of lateral portions downwardly inclined from said central portion; and a fixing means for fixing opposite lateral edges of said net cover body when fitted to respective lateral upper edges of the eaves gutter, including a pair of fixing frames continuously extending along the respective lateral edges of the net cover body in a longitudinal direction of the net cover body and mounted on the respective lateral edges of the net cover body, each of said fixing frames formed with an opening facing downwardly so as to permit a corresponding one of the lateral upper edges of the eaves gutter to be fitted therein.

2. A protection cover for an eaves gutter as defined in claim 1, wherein said net cover body is so formed that said central portion is upwardly arcuately expanded and both of said lateral portions are laterally arcuately expanded.

3. A protection cover for an eaves gutter as defined in claim 1, wherein said net cover body is formed with square meshes, and sides of each of said meshes being respectively about 4 mm.

4. A protection cover for an eaves gutter as defined in claim 2, wherein said net cover body is formed with square meshes, and sides of each of said meshes being respectively about 4 mm.

5. A protection cover for an eaves gutter as defined in claim 1, wherein said fixing frames are each constructed of a flat plate and a frame plate having a crank-shape in cross-section which are joined to each other at upper ends thereof, while interposedly holding a corresponding one of said lateral edges of said net cover body between said upper ends thereof.

6. A protection cover for an eaves gutter as defined in claim 1, wherein a lower end of said flat plate and a middle section and a lower end of said frame plate, in association with each other, form said opening so that it has an inverted U-shape.

7. A combination rain gutter and cover assembly comprising:

a rain gutter having an upper opening with a rounded lip on each edge;

a convex cover member having a porous surface for permitting the transmission of rain water, the cover member including a pair of fixing frames, each fixing frame extends respectively along one side of the cover member and each fixing frame forms a complementary opening that encompasses the rounded lip; and a wire assembly including a wire extending through the cover member to secure the cover member to the rain gutter.

8. The invention of claim 7 wherein the cover member's porous surface is formed of a stainless steel mesh.

9. The invention of claim 7 wherein the cover member's porous surface is formed of a water-resistant plastic wire.

10. The invention of claim 7 further including a support member with a pair of spaced hooks, each hook is dimensioned to extend respectively adjacent one of said fixing frames, the wire extends from one hook to the other hook and overlaps each fixing frame.

11. The invention of claim 7, wherein the convex cover member has sufficient structural strength to maintain a convex configuration when only supported by the pair of fixing frames, each fixing frame is an elongated member of approximately an h-cross-sectional shape.

12. The invention of claim 11, wherein the convex cover member and the fixing frames are formed of stainless steel.

* * * * *